US005950616A

United States Patent [19]

Armentrout

[11] Patent Number: 5,950,616

[45] Date of Patent: Sep. 14, 1999

[54] HIGH-EFFICIENCY WASTE OIL FIRE HEATER

[75] Inventor: Jeffrey S. Armentrout, Harrisonburg, Va.

[73] Assignee: Shenandoah Manufacturing Company, Inc., Harrisonburg, Va.

[21] Appl. No.: 09/201,388

[22] Filed: Nov. 30, 1998

[51] Int. Cl.[6] ..... F24H 3/02

[52] U.S. Cl. ..... 126/110 B; 126/106; 126/109

[58] Field of Search ..... 126/110 R, 110 B, 126/104 R, 104 A, 112, 116 R, 99 C, 99 D, 110 D, 99 R, 114, 106, 109

[56] References Cited

U.S. PATENT DOCUMENTS

| | | | |
|---|---|---|---|
| 2,645,278 | 7/1953 | Thouse, Sr. et al. | 126/110 B |
| 4,501,390 | 2/1985 | Modzinski | 126/110 B |
| 4,706,646 | 11/1987 | Christianon et al. | 126/109 |
| 4,955,359 | 9/1990 | Briggs et al. | 126/119 B |

*Primary Examiner*—James C. Yeung

*Attorney, Agent, or Firm*—Nixon & Vanderhye P.C.

[57] ABSTRACT

A high efficiency heater system made up of a longitudinally extending combustion chamber located within an external enclosure which is spaced apart from the combustion chamber to provide an air space. A burner assembly provides combustion gases into one end of the combustion chamber which travel down the chamber and are exhausted through flue gas vents at the other end of the chamber. An air path divider separates the air space between the upper portion of the combustion chamber and the enclosure from the air space between a lower portion of the combustion chamber and the enclosure. A blower supplies ambient air which flows into the upper air space, flows along the hottest part of the combustion chamber and then, upon reaching the flue gas end of the combustion chamber, reverses direction and travels back along the lower air space before being exhausted into the ambient air. In a preferred embodiment a swirl plate on the burner assembly imparts a swirl to the combustion gases which increases the efficiency of heat transfer as well as reduces the tendency of ash to form on the upper surface of the combustion chamber.

19 Claims, 4 Drawing Sheets

HIGH-EFFICIENCY WASTE OIL FIRE HEATER

BACKGROUND OF THE INVENTION

1. Field of Invention

The present invention relates to heating systems in general and a waste oil fire heater systems for heating ambient air by the combustion of waste oil and other materials in particular.

2. Discussion of Prior Art

The use of waste oil as a fuel source in heating systems is well known. See "Heat Exchanger" issued to James C. Wilson as U.S. Pat. 4,905,661 on Mar. 6, 1990 and "Coaxial Dual Primary Heat Exchanger" issued to James C. Wilson as U.S. Pat. 5,022,379 on Jun. 11, 1991.

Waste oil heating systems typically utilize lubricating oil which is removed from vehicle engines and other devices requiring such lubrication. This waste oil contains a number of contaminants from the engines in which they were used including unburned fuel products from such engines, minor portions of metal from wear in such engines, compounds for the control of viscosity and other contaminants (at least as far as clean combustion is concerned). When this waste oil is burned, even in the best burners, there are by-products of such combustion, such as ash or mineral deposits, which collect on the burner chamber walls.

This accumulated material, when located on the burner chamber walls acts as an insulator between the very hot combustion gases and the cooler combustion chamber walls. If, as is desirable in most oil fired heaters, the combustion chamber wall serves to convey heat to the ambient air to be heated, the accumulation of ash acting as an insulator reduces the heat transfer from the combustion gases to the ambient air to be heated and accordingly reduces the efficiency of the heat exchanger. Thus it is desirable to avoid or reduce the ash accumulation on such walls to the extent possible.

If the combustion chamber walls are permitted to rise to very high temperatures, the localized expansion of the metal may cause warping and/or other defects in the combustion chamber. Repeated heating and cooling cycles may in turn lead to high stresses and/or fracturing of the chamber walls over long periods of operation. A reduction in the wall temperatures of the combustion chambers in waste oil fired heater would tend to reduce these adverse effects.

Furthermore, high localized temperatures in the combustion chamber walls permit and encourage corrosion and/or oxidation of the walls. This can lead to early failure and/or burn through of the chamber walls.

Accordingly, in view of the above, there is a continuing problem with existing oil fired furnaces in that ash accumulation reduces the efficiency of heat transfer and high temperatures cause expansion and consequence stress in the combustion chamber as well as possible corrosion and/or oxidation of the chamber walls.

SUMMARY OF THE INVENTION

In accordance with the above, it is an object of the present invention to reduce, to the extent possible, the accumulation of ash on the hottest parts of a combustion chamber so as to increase the efficiency of heat transfer from combustion gases to the ambient air being heated.

It is a further object of the present invention to reduce the high temperature differential between different portions of a waste oil fired combustion chamber thereby reducing stress on the various portions of the combustion chamber.

It is a still further object of the present invention to reduce the overall peak temperature in a waste oil fired combustion chamber and thereby reduce or prevent corrosion and/or oxidation of the chamber walls.

The above and other objects are achieved in accordance with the present invention in which fuel is burned in a generally horizontally extended combustion chamber where the products of combustion travel from one end of the chamber to the other and are then vented to the atmosphere. The combustion chamber is contained in a heat transfer enclosure which utilizes a blower to draw in cool ambient air, circulate this air around the combustion chamber drawing heat therefrom and blowing the heated air out of the enclosure. Significant in the operation is that the ambient air is initially directed towards the hottest upper portion of the combustion chamber and thus serves to cool the most critical portion of the combustion chamber thereby preventing it from reaching temperatures which would cause undue stress on the combustion chamber metal and/or corrosion/oxidation of the combustion chamber metal.

High efficiency heat transfer is obtained by directing the combustion gases toward the upper portion of the combustion chamber which are initially cooled by the coolest ambient air. This coolest ambient air is circulated longitudinally along the hottest upper portion of the combustion chamber in the same direction as the combustion gases are flowing in the combustion chamber itself. Upon reaching the end of the enclosure, the somewhat warmed cooling air reverses direction and travels along the lower portion of the combustion chamber in a direction opposite to the combustion gas flow prior to exiting the enclosure as heated air.

In preferred embodiments of the present invention, there are two vents for combustion chamber gases, one on each side of the enclosure, and there is one vent for exiting warmed air.

BRIEF DESCRIPTION OF THE DRAWINGS

The above and other objects of the present invention will become apparent to those skilled in the art with reference to the accompanying drawings in which.

DETAILED DESCRIPTION OF PREFERRED EMBODIMENTS

Figure 1:
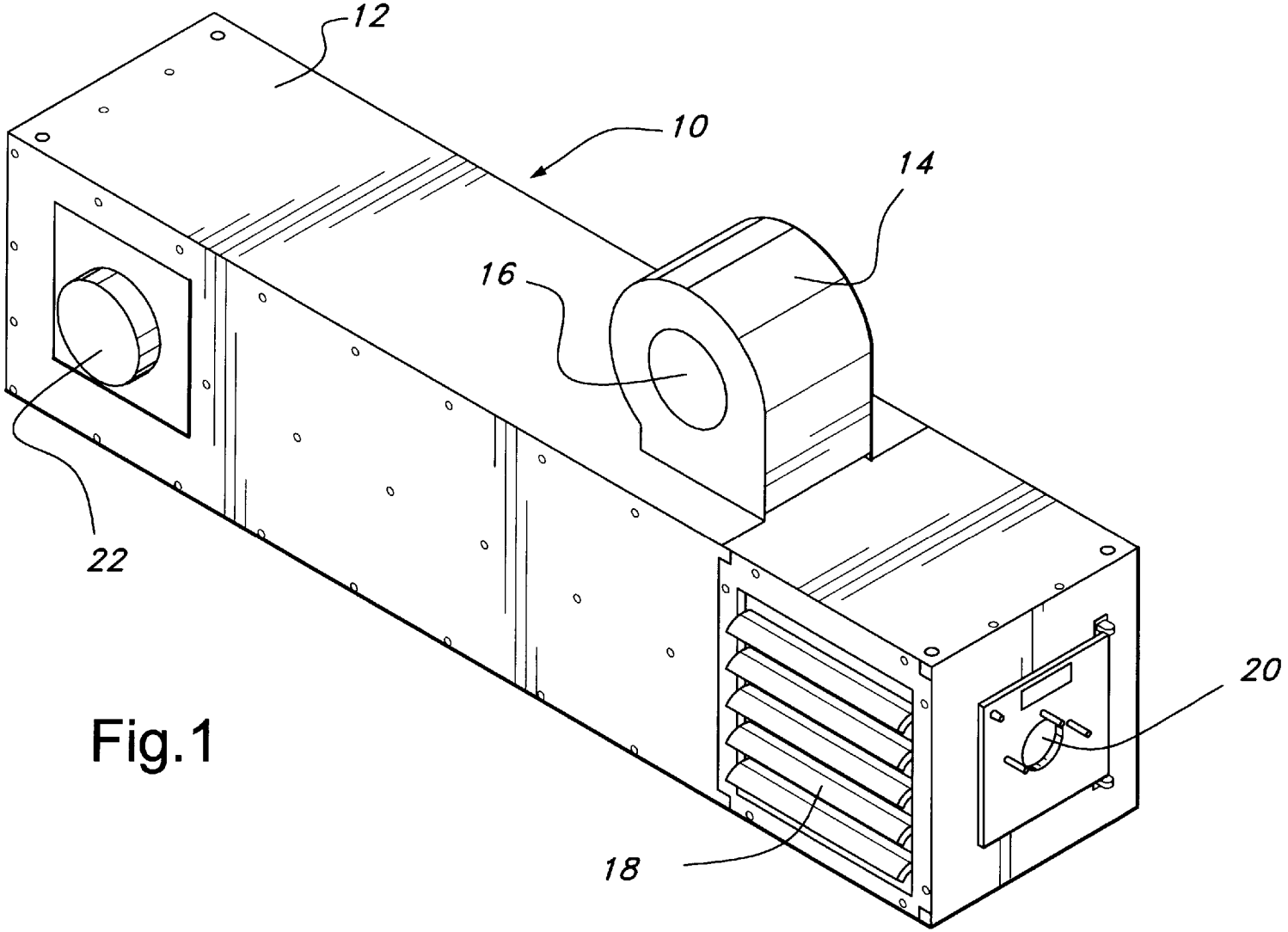
FIG. 1 is a perspective view from the combustion end of the present invention.

Similar reference numerals will be used to identify similar structural elements among with several views. In FIG. 1, the high efficiency heater system is designated generally as 10 although the burner system is not attached for simplicity's sake. The heater 10 comprises an external enclosure 12 which is supplied with ambient air under pressure by means of blower 14. The blower is shown as a centrifugal blower, mounted by screws (not shown) having an internal electric motor which draws ambient air into the enclosure 12 by way of opening 16. However an external motor could power the blower and in addition to a centrifugal blower, other types of fans or air moving equipment could be utilized.

The air provided leaves the enclosure through a heater vent comprising one or more openings which, in a preferred embodiment, includes louvers 18 which serve to direct the air heated by the heater in a desired direction. The combustion chamber (not shown in FIG. 1) is fed by a burner assembly which injects fuel and air for combustion through combustion chamber opening 20 and the products of combustion travel longitudinally along the combustion chamber and exit the heater at flue gas vent 22. In a preferred embodiment the flue gas vent is welded to the combustion chamber 30. It should be noted that the blower 14 is in closed proximity to the combustion chamber opening 20.

Figure 2:
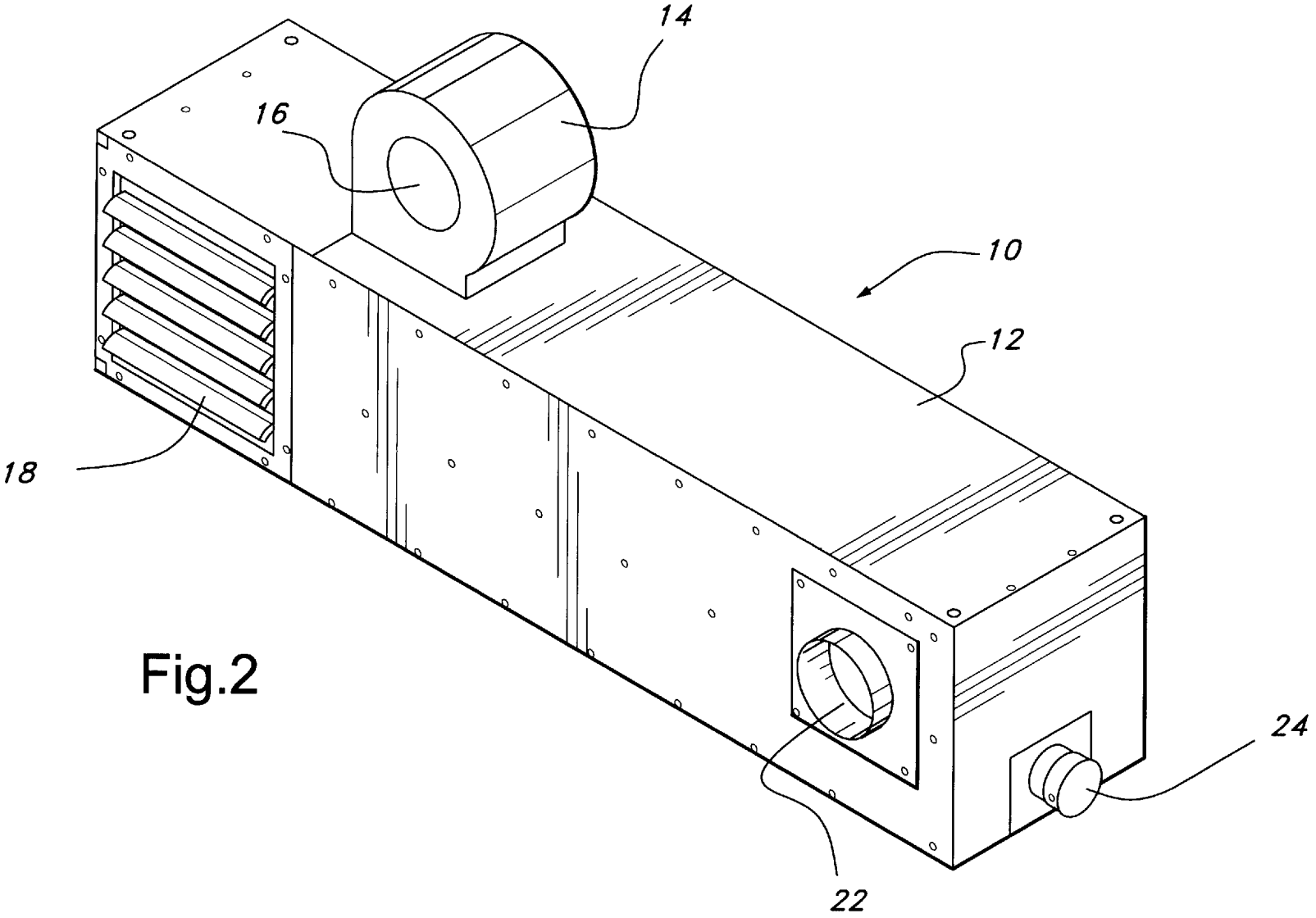
FIG. 2 is a perspective view from the exhaust end of another embodiment of the present invention.

FIG. 2 illustrates the same components identified in accordance with FIG. 1. It is noted that while louvers 18 are shown to be present on both sides of the heater 10 (in FIGS. 1 & 2), they may preferably be located on only a single side. In one preferred embodiment the louvers direct the heated air away from opening 16 of blower 14 to avoid heated air being reingested into the blower. It is also noted that flue gas vent 22 exits the enclosure 12 on either or both sides of the heater (in a preferred embodiment). FIG. 2 illustrates a further feature of the present invention in that there is an ash removal opening 24 (closed during heating operations) which permits removal of ash from the combustion chamber during maintenance operations.

Figure 3:
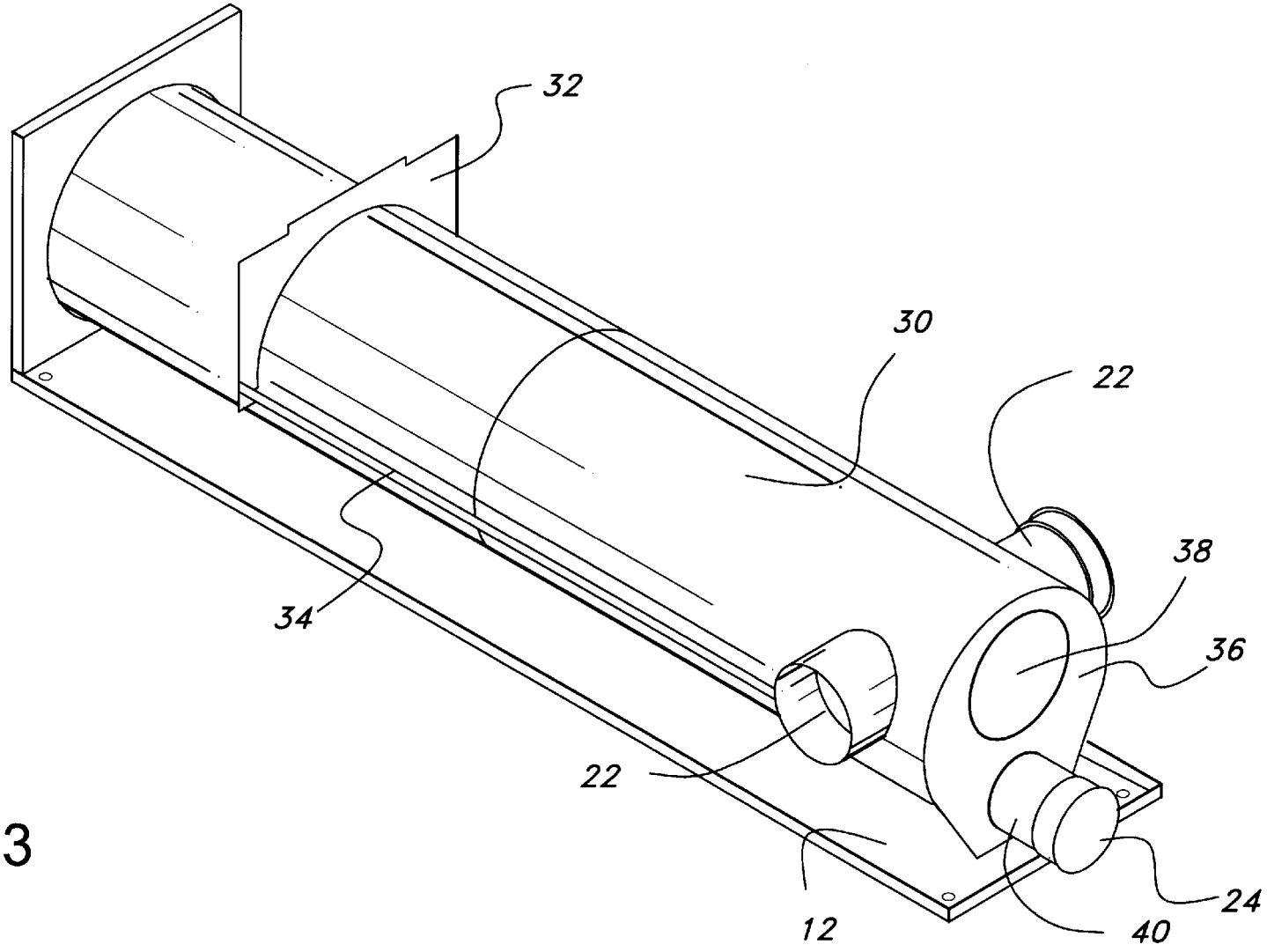
FIG. 3 is a view of the combustion chamber and air path divider configuration of the embodiment shown in FIG. 2.

FIG. 3 is a perspective view of the combustion chamber 30 with the air flow baffle 32 in place. The air path divider 32 extends between the combustion chamber 30 and the external enclosure 12 in a vertical direction as shown in FIG. 3 and also has a longitudinally extending portion 34 which also sealingly interconnects the combustion chamber 30 to the external enclosure 12 between the vertical portion of baffle 32 and flue gas vent 22 (which extends between the combustion chamber and the outside of the external enclosure 12).

Also visible in FIG. 3 is the combustion chamber end support 36 which in a preferred embodiment forms the end of the combustion chamber and also extends to the lower surface of enclosure 12 serving to support the exhaust end of the combustion chamber relative to the external enclosure. Also visible in FIG. 3 is the opening of heat transfer can 38, also welded to the combustion chamber and which extends into the combustion chamber a short distance. It will be noted that the combustion chamber does not extend the entire length of enclosure 12 allowing air to circulate around the end of the combustion chamber and the flue gas vents 22, into the heat transfer can 38 and around the pipe 40 connecting ash removal opening 24 to the lower portion of the combustion chamber 30.

Figure 4:
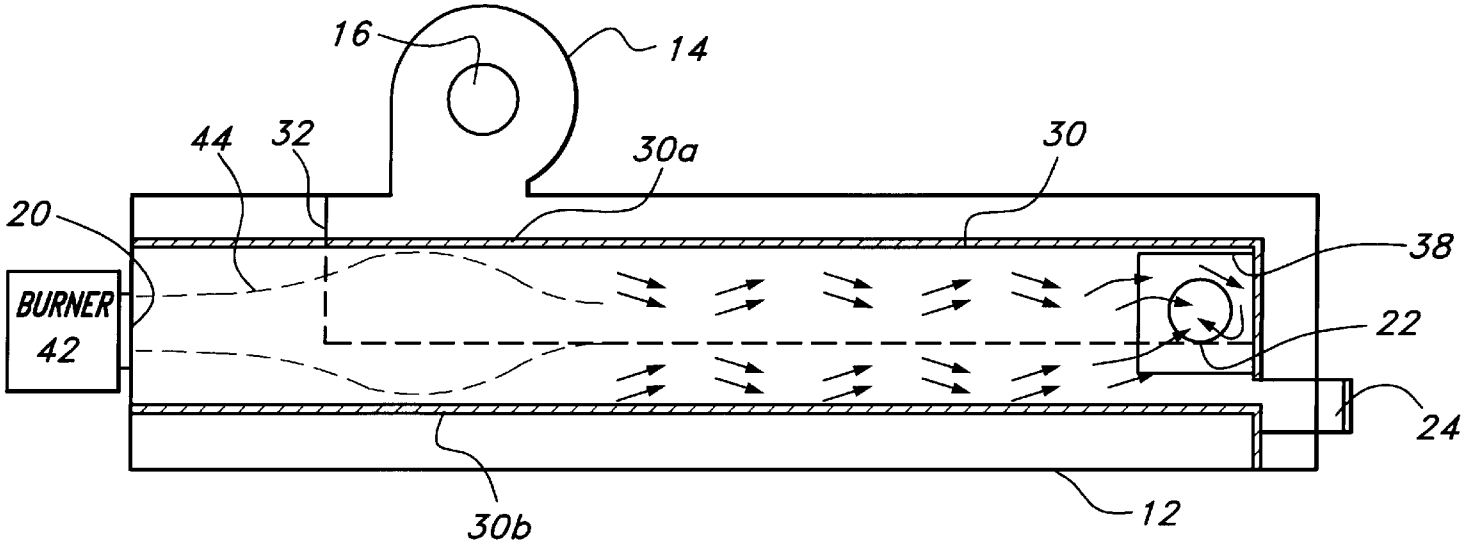
FIG. 4 is a side cross-sectional view showing the flow of combustion gases in accordance with one embodiment of the present invention.
Figure 5:
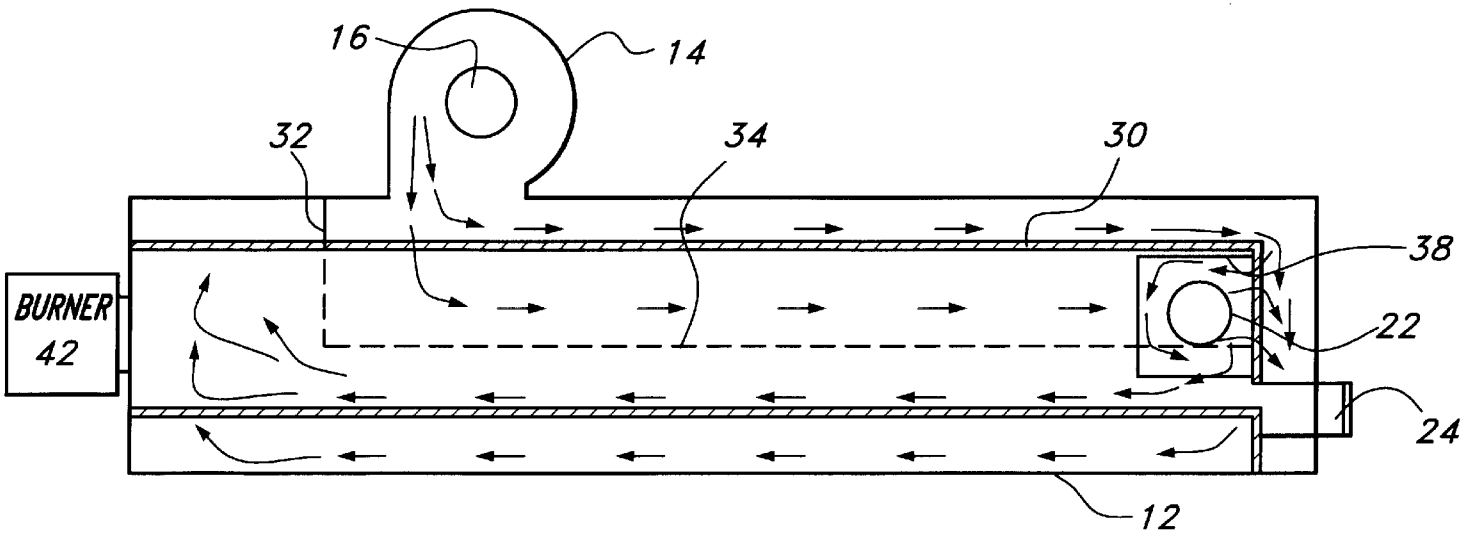
FIG. 5 is a side cross-sectional view showing the flow of cooling air in accordance with one embodiment of the present invention.

A more complete understanding of the combustion gas flow as well as the ambient air flow can be seen by references to FIGS. 4 and 5.

FIG. 4 is a side view of a preferred embodiment of the present invention in which a generic burner 42 supplies and ignites a mixture of waste oil and air to form burner flame 44 (as shown in FIG. 4 by the labeled dotted lines). In a preferred embodiment this burner flame is a swirling flame in which combustion products travel in a swirling motion longitudinally down the combustion chamber before exiting the combustion chamber through one or more flue gas vents 22. Because the hottest gases normally rise towards the upper portion of the combustion chamber, the hottest combustion chamber wall will be the upper wall 30*a* and the coolest wall will be the lower wall 30*b*.

The swirling gases in a preferred embodiment are believed to help prevent ash accumulation on the upper wall. However, some ash does precipitate in layers on the inner surfaces of the combustion chamber. The ash, upon precipitating, becomes brittle and flakes off (in part due to vibrations in blower 14) and falls to the bottom of the combustion chamber. It can be seen that during maintenance this ash can be removed through ash removal opening 24 (normally closed during operation of the heater).

It can also be seen that in the preferred embodiment hot combustion gases flow around heat transfer can 38 before passing out of the combustion chamber through flue gas vents 22. Since this can is located in the upper portion of the combustion chamber, it will be substantially heated by the combustion gases prior to their departure from the combustion chamber.

FIG. 5 illustrates the flow of ambient air brought in through opening 16 by blower 14 passing into the enclosure. As previously discussed, there is an air path divider 32. The air path divider 32 and the longitudinally extending portion 34 divides the space between combustion chamber 30 and external enclosure 12 into upper and lower sections. The air is forced into the upper section at one end, travels longitudinally from left to right as shown in FIG. 5. Because the longitudinally extending portion 34 terminates prior to the end of the enclosure 12 (in a preferred embodiment it terminates on the surface of flue gas vent 22) the air can flow through the end space between the end of combustion chamber 30 and enclosure 12. After reversing direction, the air flow travels in the lower section in a direction substantially opposite to that of the combustion products until reaching louvers 18 whereupon the air exits the heater (the exiting air is shown by the sharp angles in air flow arrows at the left hand portion of FIG. 5). Because of the turbulence in air flow and the hot nature of heat transfer can 38, air flows into and out of this can absorbing heat therefrom before flowing to the lower section of the heater.

It will be noticed in FIGS. 4 and 5 that the blower 14 is located so as to direct the coolest air on the hottest portion of combustion chamber 30. Because heat transfer is a function of the combustion chamber material, the temperature difference across the chamber material and the flow of gases along the surfaces of the material, the highest heat transfer will generally occur in the region of 30*a* in FIG. 4. While this serves to initially heat the incoming air, it also beneficially provides the greatest amount of cooling to the hottest portion of the combustion chamber.

Accordingly, during operation, the combustion chamber maintains a relatively uniform temperature along its upper and lower surfaces even though there is a substantial temperature difference inside the combustion chamber with respect to the combustion products adjacent the upper and lower surfaces. Thus the present embodiment prevents hot spots in the combustion chamber which could cause corrosion and/or oxidation of the combustion chamber material.

Burner 42 can be any conventional waste oil burner assembly but in a preferred embodiment includes a flame retention head and/or vanes which cause the combustion gases to swirl as discussed above in conjunction with FIG. 4. The swirling action, in addition to contributing to flaking off of any ash clinging to the internal surfaces of the upper portion of the combustion chamber, is also believed to improve the heat transfer between the hot gases in the combustion chamber and the cooler ambient air being circulated by blower 14.

It will also be appreciated by those of ordinary skill in the art that while a preferred embodiment of the present invention is made of sheet metal and/or stainless steel, any suitable material having a reasonably good heat transfer coefficient and susceptible to withstanding the combustion chamber temperatures could be utilized. In a preferred embodiment, the bottom and end of the enclosure on which the burner is mounted are 14 guage aluminized steel. The remainder of the external enclosure is comprised of 20 guage galvannealed steel. The combustion chamber 20 and the air path divider, in the preferred embodiment, are comprised of 18 gauge aluminized steel.

While any conventional method of joining the portions of the heater together could be used, for example bolts, screws, rivets, etc., in the preferred embodiment the blower is mounted on the external enclosure by means of screws. The combustion chamber and its end caps, the heat transfer can, the ash removal opening, the airpath divider and the flue gas vents are all at least spot welded together and where a gas tight joint is desired, they are joint welded together. Further, fins and/or other elements could be located on the combustion chamber surface in order to improve the heat conduction from the combustion chamber as a substitute for or in addition to the heat transfer can 38.

In accordance with the above, many modifications and variations of the disclosed high efficiency heater system will be readily apparent to those of ordinary skill in the art. Accordingly, the present invention is limited only by the structural limitations contained in the following claims.

What is claimed is:

1. A high efficiency heater system for heating ambient air, said system comprising:

a longitudinally extended combustion chamber;

a burner assembly located at one end of said combustion chamber;

an external enclosure, enclosing at least a portion of said combustion chamber, said enclosure at least partially spaced apart from said combustion chamber so as to define an air space between at least a portion of said enclosure and said at least a portion of said combustion chamber;

a flue gas vent, at another end of said combustion chamber and extending from said combustion chamber at least partially through said air space, for conveying products of combustion out of said combustion chamber;

an air path divider, at least partially extending substantially longitudinally between said combustion chamber and said enclosure, dividing said air space between upper and lower sections at least adjacent said one end of said combustion chamber;

a blower for supplying said ambient air to said upper section at a location at least adjacent said one end of said combustion chamber; and a heater vent permitting heated air to escape from said air space.

2. A high efficiency heater system in accordance with claim 1, wherein said blower comprises a centrifugal blower.

3. A high-efficiency heater system in accordance with claim 1, wherein said burner assembly comprises an oil fueled burner assembly.

4. A high-efficiency heater system in accordance with claim 3, wherein said oil fired burner assembly comprises a waste oil fired burner assembly.

5. A high efficiency heater system in accordance with claim 1, wherein said combustion chamber comprises a substantially cylindrical combustion chamber.

6. A high efficiency heater system in accordance with claim 5, wherein said cylindrical combustion chamber has an end upon which said burner assembly is mounted and has an opposite end located inside said external enclosure.

7. A high efficiency heater system in accordance with claim 5, wherein said combustion chamber end includes a heat transfer can mounted on the end of the combustion chamber with the can extending into the combustion chamber.

8. A high efficiency heater system in accordance with claim 1, wherein said burner assembly includes a flame holder.

9. A high efficiency heater system in accordance with claim 8, wherein said flame holder includes a swirl device.

10. A high efficiency heater system in accordance with claim 1, wherein said enclosure has a rectangular cross-section.

11. A high efficiency heater system in accordance with claim 1, wherein said flue gas vent comprises a transverse conduit.

12. A high efficiency heater system in accordance with claim 11, wherein said transverse conduit comprises two flue gas vents.

13. A high efficiency heater system in accordance with claim 12, wherein said combustion chamber comprises a cylindrical combustion chamber having an end inside the enclosure.

14. A high efficiency heater system in accordance with claim 13, wherein said combustion chamber includes a heat transfer can at the end of the combustion chamber, said can extending into said combustion chamber.

15. A high efficiency heater system in accordance with claim 14, wherein said air path divider extends substantially longitudinally to said flue gas vents.

16. A high efficiency heater system in accordance with claim 1, wherein said air path divider extends from said one end adjacent the burner assembly towards the flue gas vent end of said combustion chamber.

17. A high efficiency heater system in accordance with claim 16, wherein said air path divider extends to said flue gas vent.

18. A high efficiency heater system in accordance with claim 1, wherein said heater vent is located near said burner assembly.

19. A high efficiency heater system for heating ambient air, said system comprising:

a longitudinally extended combustion chamber;

a burner assembly located at one end of said combustion chamber, said burner providing combustion products traveling in a direction from said one end of said combustion chamber to another end;

an external enclosure, enclosing at least a portion of said combustion chamber, said enclosure at least partially spaced apart from said combustion chamber so as to define an air space between at least a portion of said enclosure and said at least a portion of said combustion chamber;

an air path divider at least partially extending substantially longitudinally between said combustion chamber and said enclosure, and dividing said air space between upper and lower sections at least adjacent said one end of said combustion chamber;

a blower for supplying said ambient air to said upper section at least adjacent said one end of said combustion chamber, said ambient air first traveling from said upper section near said blower in a direction substantially the same as said combustion products travel in said upper section, said ambient air secondly reversing direction and traveling in said lower section in a substantially opposite direction; and a heater vent permitting heated air to escape from said air space.

* * * * *